United States Patent [19]

Oka

[11] Patent Number: 4,578,337

[45] Date of Patent: Mar. 25, 1986

[54] DRY PROCESS FOR DEVELOPING ELECTROSTATIC LATENT IMAGES WITH A DEVELOPER COMPRISING TWO KINDS OF MAGNETIC CARRIERS HAVING DIFFERENT PHYSICAL STRUCTURE

[75] Inventor: Tateki Oka, Toyohashhi, Japan

[73] Assignee: Minolta Camera Kabushiki Kaisha, Osaka, Japan

[21] Appl. No.: 600,409

[22] Filed: Apr. 16, 1984

[30] Foreign Application Priority Data

Apr. 15, 1983 [JP] Japan ..... 58-67488

[51] Int. Cl.[4] ..... G03G 9/08; G03G 9/10; G03G 9/14

[52] U.S. Cl. ..... 430/107; 430/106.6; 430/120; 430/122

[58] Field of Search ..... 430/120, 122, 106.6, 430/107

[56] References Cited

U.S. PATENT DOCUMENTS

| | | | |
|---|---|---|---|
| 2,846,333 | 5/1958 | Wilson | 430/122 |
| 2,890,968 | 6/1959 | Giaimo | 430/122 |
| 3,015,305 | 1/1962 | Hall et al. | 430/122 X |
| 3,627,682 | 12/1971 | Hall et al. | 430/106.6 |
| 3,895,125 | 7/1975 | Tsuchiya et al. | 427/18 |
| 4,287,281 | 9/1981 | Bayley | 430/106.6 X |
| 4,404,269 | 9/1983 | Miyakawa et al. | 430/106.6 |
| 4,436,802 | 3/1984 | Ohtsuka et al. | 430/122 X |
| 4,436,803 | 3/1984 | Ikeda et al. | 430/122 |
| 4,485,162 | 11/1984 | Inamura et al. | 430/122 X |

FOREIGN PATENT DOCUMENTS 57-204560 12/1982 Japan .

*Primary Examiner*—John E. Kittle
*Assistant Examiner*—Mukund J. Shah
*Attorney, Agent, or Firm*—Wenderoth, Lind & Ponack

[57] ABSTRACT

There is provided a process for developing electrostatic latent images comprising using a dry magnetic developer comprising an insulating toner and magnetic carriers, said magnetic carriers comprising a ferromagnetic carrier composed of a ferromagnetic material and a binder-type magnetic carrier, said ferromagnetic carrier being composed of resin-coated or bare particles of a ferromagnetic material, said binder-type magnetic carrier being composed of particles of a powdered magnetic material dispersed in a resin binder and having a coercive force greater than that of the ferromagnetic carrier.

15 Claims, 2 Drawing Figures

DRY PROCESS FOR DEVELOPING ELECTROSTATIC LATENT IMAGES WITH A DEVELOPER COMPRISING TWO KINDS OF MAGNETIC CARRIERS HAVING DIFFERENT PHYSICAL STRUCTURE

BACKGROUND OF THE INVENTION

This invention relates to a process for developing electrostatic latent images and more particularly to a process for developing electrostatic latent images with a two-component magnetic developer composed of a toner and a carrier.

One of the well-known dry processes for development of electrostatic latent images is a magnetic brush development which comprises triboelectrically charging toner particles to a polarity opposite to that of an electrostatic latent image, forming a magnetic brush of the developer by magnetic attraction, and brushing a latent image-carrying element with the magnetic brush to form a visible toner image on the element. A dry developer for the magnetic brush development is generally composed of two components, i.e., an insulating toner having an average particle diameter of about 10 to 20 microns, and a magnetic carrier such as, for example, iron, powder having an average particle diameter of about 100 to 200 microns.

In the magnetic brush development, the toner particles attracted to the surfaces of the carrier particles are consumed during development, whereas the carrier particles are not and replenished with toner particles for the repeated use. Thus, the consumption of the toner causes the developer to change in the composition, resulting in the deterioration of the image quality of the copies. In the practical applications, the developer is replenished with a fresh toner to keep the mixing ratio of toner to carrier constant. However, it is difficult to accurately control the mixing ratio of toner to carrier since the available range of the mixing ratio is too narrow to maintain the same within a proper range. Also, the developer must be periodically replaced with new one because repeated use of the carrier particles causes the toner to form a thin film on the surface of the carrier particle during prolonged use. The replacement of the developer is uneconomical and makes it troublesome to maintain the developing device to normal conditions.

To solve these problems, it has been proposed to use a ferrite as a material for carrier. The use of the ferrite carrier makes it possible to obtain electrophotographic copies with a high image density, but has problems awaiting a solution. The image quality can be improved by the use of ferrite carrier having a smaller particle size. The smaller the particle size of the carrier, the greater the magnetic attraction between the carrier particles, resulting in the aggregation of the carrier particles in a hard fin-like form. The hard fin-like arrangement of the carrier particles reduces its carrying properties and causes the formation of white lines in the solid black area of the copy. Also, the ferrites have a volume resistivity of about $10^9$ ohm-cm, so that the charges on the latent image-carrying element would leak away from the surface because of lowering of the toner content in the developer, resulting in the disappearance of the image and attraction of the carrier particles on the image area. If the ferrite carrier particles are attracted to the latent image-carrying element, the surface of the element would be damaged by the hard ferrite particles when removing residual toner particles on the element. In addition, the line images cannot be reproduced sharply. The volume resistivity of the ferrite carrier may be improved by coating the carrier particles with an insulating resin, but the aggregation of the carriers cannot be prevented by coating. Since the coated ferrite carrier particles have a tendency to be heavily charged, the carrier particles are attracted to the non-image area of the element by the triboelectrical attraction, resulting in the damage of the element.

SUMMARY OF THE INVENTION

It is therefore an object of the present invention to provide a new and improved process for developing electrostatic latent images which overcomes the above deficiencies.

Another object of the present invention is to provide a process for developing electrostatic latent images which makes it possible to achieve high quality development.

Further object of the present invention is to provide a process for developing electrostatic latent images which makes it possible to produce clear and sharp copies with a high resolution without fogging and aggregation of carrier particles.

Still another object of the present invention is to provide a process for developing electrostatic latent images which makes it possible to reproduce electrophotographic copies with a high image density.

According to the present invention there is provided a process for developing electrostatic latent images comprising using a dry developer comprising an insulating toner, a ferromagnetic carrier composed of a ferromagnetic material, and a binder-type magnetic carrier composed of a powdered magnetic material dispersed in a resin binder and having magnetic properties different from that of the ferromagnetic carrier.

As the insulating toner in the developer used in the process of the present invention, there may be used those comprising a thermoplastic resin and a pigment dispersed therein, or those further containing a charge control agent and/or a magnetic material dispersed in the thermoplastic resin. It is preferred to use an insulating toner having an average particle diameter of 9 to 20 microns, and a volume resistivity of not less than $10^{12}$ ohm-cm. The values of volume resistivity for the toner are those measured under a DC electric field of $10^4$ v/cm throughout the specification. As a thermoplastic resin used for the preparation of toner particles, there may be used those such as, for example, polystyrene, styrene-acrylonitorile copolymers, styrene-methylmethacrylate copolymers, acrylic resins, epoxy resins, fluoroplastics and polyester resins. If a finely powdered magnetic material is incorporated into a composition of the toner, it is preferred to use powder such as iron powder, magnetic iron oxide powder, ferromagnetic ferrites, having an average particle diameter of not more than 3 microns.

The ferromagnetic carrier in the developer used in the process of the present invention includes bare particles of a ferromagnetic material of a soft type, and resin-coated particles of the ferromagnetic material. A preferred ferromagnetic material has a composition consisting essentially of ferric oxide and one or more oxides of metals selected form the group of nickel, manganese, magnesium and zinc. It is preferred to use a ferromagnetic carrier having an average particle diameter of 35 to 90 microns. If the average particle diameter of the ferromagnetic carrier is less than 35 microns, the image density become lowered because of lowering of the carrying properties of the developer. If the average particle diameter is more than 90 microns, the carrier particles would aggregate in a hard fin-like form, resulting in the formation of white lines in a solid black image area, and making it difficult to reproduce fine detailed images. It is also preferred to use a ferromagnetic carrier having a volume resistivity of $10^7$ to $10^{10}$ ohm-cm. Since the ferrites have in general a volume resistivity of $10^7$ to $10^{10}$ ohm-cm, any of the known ferrites may be employed as a material for ferromagnetic carriers. Values of the volume resistivity for carriers are those measured under a DC electric field of $5\times10^2$ v/cm throughout the specification. The preferred ferromagnetic carrier has magnetic properties different from that of the binder-type magnetic carrier and, preferably, has a coercive force approximately equal to 0.

The binder-type magnetic carrier in the developer used in the process of the present invention generally comprises a thermoplastic resin and a powdered magnetic material dispersed therein. A conductivity control agent and/or a charge control agent may be incorporated into a composition of the binder-type magnetic carrier. It is preferred to use a binder-type magnetic carrier having an average particle diameter of 20 to 55 microns. If the average particle diameter is less than 20 microns, the binder-type carrier particles have a tendency to cling to the surface of the latent image-carrying element. If the average particle diameter is more than 55 microns, it is difficult to achieve the reproduction of detailed images. As a magnetic material, there may be used those such as iron powder, magnetic iron oxide powder, ferrite and the like. It is preferred to use a magnetic powder having an average particle diameter of not more than 3 microns. It is preferred to use a binder-type magnetic carrier having a coercive force of not less than 60 öersteads. The coercive force of the binder-type carrier may be controlled by the proper selection of the kind of a magnetic material and the mixing ratio of the magnetic powder to the binder resin. The binder resin may be any of the thermoplastic resins used for the preparation of the insulating toner. Thermosetting resins may be used as a binder resin for the binder-type carrier. It is also preferred to use a binder-type magnetic carrier having a volume resistivity of not less than $10^{12}$ ohm-cm. If the volume resistivity is less than that value, the binder-type carrier causes the developer to have a low volume resistivity, resulting in the leakage of electrical charges on an electrostatic latent image-carrying element or photosensitive drum. To improve the carrying property of the developer, it is preferred to use a binder-type carrier having an average particle diameter smaller than that of the ferromagnetic carrier.

In a preferred embodiment, the binder-type magnetic carrier is mixed with the ferromagnetic carrier so that the content of the ferromagnetic carrier in the developer is 10 to 80 wt% of the combined amount of the ferromagnetic carrier and the binder-type carrier. If the toner is of substantially nonmagnetic, it is preferred to mix the ferromagnetic carrier and binder-type carrier so that the content of the ferromagnetic carrier is 20 to 80 wt% of the combined amount of these carriers. If the toner is of magnetic, it is preferred to mix the ferromagnetic carrier and the binder-type carrier so that the content of the ferromagnetic carrier is 10 to 70 wt% of the combined amount of these carriers. If the content of the ferromagnetic carrier in the combined amount of the carriers is less than the minimum value, the developer would lose its good carrying property and the binder-type carrier would have a tendency to cling to the surface of the latent image-carrying element. If the content of the ferromagnetic carrier in the carrier mixture exceeds the maximum value, white lines would be formed in the solid black area of the copies because of the aggregation of the developer.

These and other objects, features and advantages of the present invention will be further apparent from the following description taken in conjunction with the accompanying drawings which show, by way of example only, preferred embodiments thereof.

DETAILED DESCRIPTION OF THE INVENTION

Any suitable type of magnetic brush developing devices may be employed to carry out the process of the present invention. Preferred developing devices include those comprising a cylinder or developing sleeve, and a magnet roller having a plurality of magnetic poles arranged around its periphery so that neighbouring two magnetic poles have a polarity opposite to that of the other. The developing device may be the one comprising a rotating cylinder having a fixed magnetic roller arranged inside, or comprising a fixed developing sleeve having a rotating magnet roller arranged inside, or comprising a rotating developing sleeve having a rotating magnetic roller arranged inside. In the last mentioned system, the developing sleeve may be rotated in a direction same as or opposite to that of the magnet roller.

Figure 1:
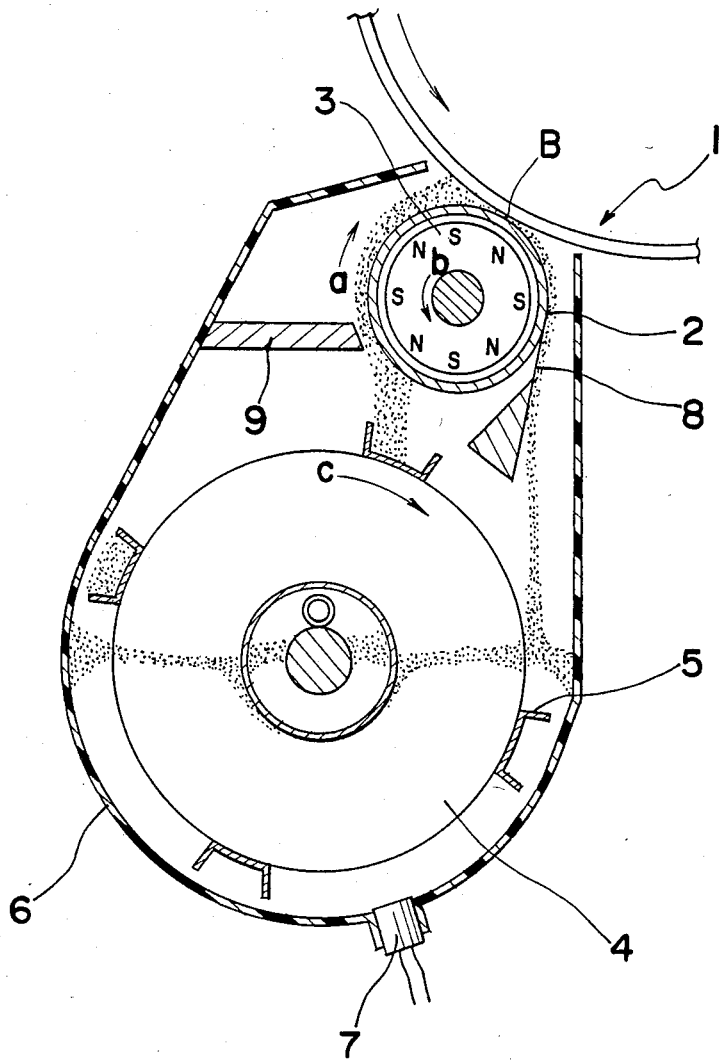
FIG. 1 is a schematic sectional view of an electrophotographic copying machine of toner image transfer type comprising an electrostatic latent image developing device for use in a process of the present invention.

Referring now to FIG. 1, there is shown an electrophotographic copying machine comprising one preferred form of a developing device used for carrying out the process of the present invention with a dry developer. In the electrophotographic copying machine, devices for charging, exposing, developing, transferring and cleaning are stationed with propriety around the circumference of a photosensitive drum 1, and all the operations take place in sequence as the drum rotates. The developing device comprises a nonmagnetic cylinder or developing sleeve 2 arranged parallel to the photosensitive drum 1, a rotating magnet roller 3 arranged in the developing sleeve 2, and a rotating bucket roller 4 for conveying the triboelectrically charged developer in a casing 6 to the developing sleeve 2.

The developing sleeve 2 is made of a nonmagnetic, conductive material such as, for example, aluminum in a cylindrical form, and rotatably arranged with a narrow gap between the developing sleeve 2 and the photosensitive drum 1. The developing sleeve 2 rotates in the direction indicated by an arrow (b) at a predetermined low speed. The developer in the casing 6 is conveyed in the vicinity of the surface of the developing sleeve 2 by rotating the bucket roller 4, and attracted to the surface of the developing sleeve 2 to form a magnetic brush by the magnetic attraction of the magnet roller 3.

The magnet roller 3 has a plurality of magnetic poles arranged around its periphery so that the neighbouring two magnetic poles of the magnets have a polarity opposite to that of the other. The magnet roller 3 rotates in the direction indicated by an arrow (b) at a predetermined high speed, and causes the developer to move over the sleeve 2 in the direction indicated by an arrow (a). The developer comprises an insulating toner, a ferromagnetic carrier and a binder-type magnetic carrier.

Provided in the bottom of the casing 6 is a senser 7 for detecting a change of the inductance due to a change of eddy current which is caused by the presence of developer. Since the inductance of the senser depends on the resistivity and magnetic permeability of the developer which, in turn, depend on the composition of the developer, the toner content of the developer, or the consumption or replenishment of toner in the developer can be detected as the change of the inductance. The toner and carriers in the developer used in the process of the present invention differs in the physical properties, particularly, in the magnetic permeability, so that the inductance of the senser varies greatly with a small change of the developer composition, thus making it possible to detect the toner content, or mixing ratio of toner to carrier in the developer with a high accuracy. A scraper blade 8 is arranged to remove the developer which remains on the surface of the developing sleeve 2 after being in light brushing contact with the drum 1. A doctor blade 9 is provided to keep the magnetic brush on the sleeve 2 to a predetermined length.

Using the developing device of FIG. 1, the process for developing electrostatic latent images according to the present invention may be carried out in the following manner: A developer placed in the casing 6 is agitated by the rotating bucket roller 4 which rotates in the direction of the arrow (c), so that the toner and carrier particles of the developer are triboelectrically charged to a polarity opposite to that of the other. A part of the developer in the casing 6 is conveyed by the buckets 5 in the vicinity of the surface of the developing sleeve 2, and the toner and carrier particles triboelectrically charged are attracted to the developing sleeve 2 by the magnetic attraction of the rotating magnetic roller 3 to form a magnetic brush on the sleeve 2. The magnetic brush is rotated and carried in the direction of the arrow (a) to the developing area (B) where the magnetic brush is brought into light brushing contact with the surface of the photosensitive drum 1 on which latent images have been formed, and the toner particles triboelectrically attracted to the carrier particles are attracted to the surface of the drum 1 to form visible toner images on the drum 1. The carrier-rich developer on the sleeve 2, after passing through the developing area (B), are removed from the developing sleeve 2 by the scraper 8, returned to the casing 6, and then agitated with the developer therein.

Figure 2:
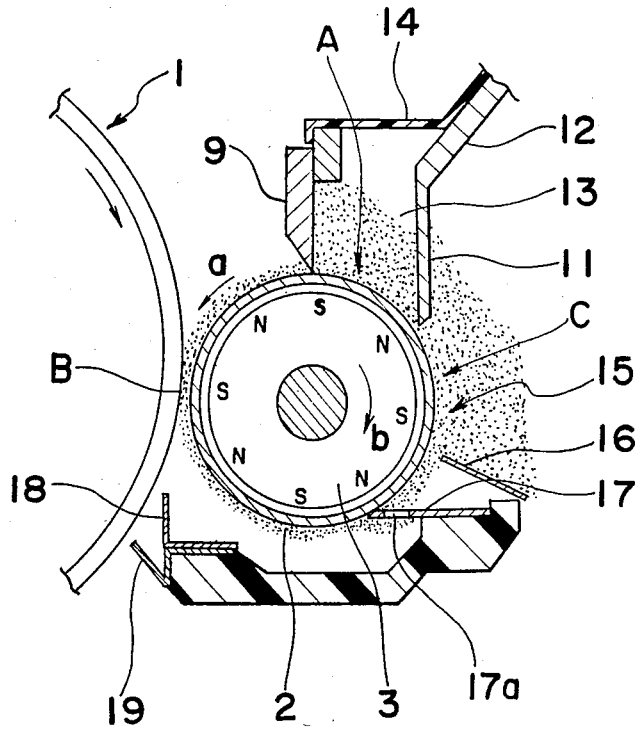
FIG. 2 is a schematic sectional view of another form of an electrophotographic copying machine of toner image transfer type comprising an electrostatic latent image developing device for use in the present invention.

FIG. 2 shows an electrophotographic copying machine comprising another form of an electrostatic latent image developing device used for carrying out the process of the present invention with a developer composed of an insulating magnetic toner, a ferromagnetic carrier and a binder-type magnetic carrier. The developing device comprises a developing sleeve 2 which rotates at a predetermined low speed in a direction indicated by the arrow (a) and opposite to that of the rotating magnet roller 3, and carries the magnetic brush in the direction of the arrow (a). In this device, the carrier placed in a tank 13 are attracted to the surface of the developing sleeve 2 by the magnetic attraction to form a magnetic brush, and the magnetic toner housed in a tank 12 are mixed and triboelectrically charged when the magnetic brush passes through a toner replenishing area (C).

The developing device is provided with a preliminary brush control plate 11 upstream of the doctor blade 9. The control plate 11 is formed integrally with the toner replenishing tank 12 and so arranged that a gap is leaved between its free end and the peripheral surface of the developing sleeve 2.

A carrier tank 13 formed between the control plate 11 and the doctor blade 9 is provided at its top portion with a cover plate 14. Placed in the tank is a carrier mixture composed of a ferromagnetic carrier and a binder-type magnetic carrier. The carrier tank 13 has an opening facing to the periphery of the developing sleeve 2 to form a carrier feeding area (A).

The toner replenishing tank 12 has an opening 15 facing to the periphery of the sleeve 2 upstream of the carrier tank 13 to form a toner replenishing area (C). A bottom plate 16 and a perforated scraper 17 are appropriately stationed around the circumference of the sleeve 2. Arranged below the developing area (B) are plates 18, 19 for preventing spill of the developer from the developing device.

In operation, a suitable amount of a carrier mixture is placed in the carrier tank 13 through its top, and the developing device is preliminary operated to form a magnetic brush on the sleeve 2. After forming the magnetic brush on the sleeve 2, the insulating magnetic toner is placed in the toner tank 12, thereby making it possible to develop the latent image on the drum 1. The carrier mixture to be placed in the tank 13 may contain a small amount of the toner. During operation, the magnetic brush is carried in the direction of the arrow (a) and passed through the gap between the surface of the sleeve 2 and the doctor blade 9, and then brought into light contact with the surface of the drum 1 at the developing area (B).

The magnetic toner particles are triboelectrically charged and attracted to the magnetic brush as the magnetic brush passes through the toner replenishing area (C). At the boundary layer between the magnetic brush and the toner in the tank 12, the toner and carrier particles are mixed in a predetermined ratio and form a magnetic developer. The mixing ratio of the toner to carrier is substantially determined by the amount of the carrier contained in the tank 13. The magnetic brush of the developer is brought into light brushing contact with the surface of the photosensitive drum 1, thereby causing the electrostatic latent images on the drum 1 to be developed to form visible toner images on the drum. The developer which remains on the sleeve 2 is scraped off therefrom by the perforated scraper 17, passed through the perforations 17*a* in the scraper 17, reattracted on the sleeve 2 by the magnetic attraction, and then replenished with the toner particles.

The process for developing electrostatic latent images according to the present invention makes it possible to reproduce sharp and fine detailed images with high density without fogging and aggregation of the carrier particles.

The photosensitive drum 1 may have any known photoconductive layer comprising an inorganic or organic photoconductive material. The typical inorganic photoconductive materials include, without being limited to, sulfur, selenium, zinc sulfide, lead oxide, rhodium selenide, Se-As and Se-Te. The typical organic photoconductive materials include, without being limited to, triphenyl amine, 2,4-bis(4,4'-diethylanimophenol)-1,3,4 -oxydiazole, N-isopropyl carbazole, charge transport complexes of trinitrofluorenone-polyvinyl carbazole, copper phthalocyanines, and their mixtures.

EXAMPLE 1

(Preparation of ferromagnetic carrier)

There was prepared a slurry by adding 3000 g of a metal oxide mixture comprising 63.3 wt% of ferric oxide having an average particle diameter of 0.55 microns, 25.9 wt% of zinc oxide having an average particle diameter of 0.1 micron, and 10.8 wt% of nickel oxide having an average particle diameter of 13 microns, into 1195 g of water. The resultant slurry was added with 98 g of a 25 wt% solution of sodium polymethacrylate, Darvan 7(Trademark of R. T. Vanderbilt Company), spray-dried with an atomizer, and then fired in air at 1190° C. for 2 hours to prepare a powder of a ferrite having a composition $(NiO)_{0.3}(ZnO)_{0.7}(Fe_2O_3)_{0.85}$. The ferrite powder was classified to prepare a ferromagnetic carrier having an average particle diameter of 50 microns.

The resultant ferromagnetic carrier was subjected to measurements of magnetic and physical properties. The volume resistivity was measured under an electric field of $5\times10^2$ v/cm by applying a DC voltage. The results were as follows:

Coercive force: about 0 e,uml/o/ erstead
Volume resistivity: $1.1\times10^8$ ohm-cm
Absolute specific gravity: 4.8

(Preparation of binder-type magnetic carrier)

There was prepared a binder-type magnetic carrier having an average particle diameter of 37 microns in the following manner: 100 parts by weight of stylene-acrylnitorile copolymer "Hymer SBM73" (Trademark of Sanyo Chemical Industries, Ltd.), 200 parts by weight of magnetic iron oxide "RB-BL" (Trademark of Titan Kogyo K.K.; average particle diameter: 0.55 microns), and 4 parts by weight of carbon black were fused and mixed in a ball-mill for 20 hours, and then milled with a three-roll mill to prepare an uniformly dispersed mixture. The resultant mixture, after being cooled, was crushed with a feather mill to a particle diameter of not more than 5 mm, and then powdered with a jet mill to prepare fine powder. The resultant powder was classified to obtain a binder-type magnetic carrier having an average particle diameter of 37 microns. The magnetic and physical properties of the carrier are as follows:

Coercive force: 200 öerstead
Volume resistivity: $10^{14}$ ohm-cm
Absolute specific gravity: 2.4

(Preparation of insulating toner)

A mixture was prepared by fusing and mixing 100 parts by weight of stylene-acrylonitrile copolymer "Pliolite ACL" (Trademark of Goodyear Tire & Rubber Company), 5 parts by weight of carbon black, and 5 parts by weight of a positive charge control agent, "Nigrosine Base EX" (Orient Kagaku Co., Ltd.) in a ball-mill, cooled, crushed and then powdered.

The resultant powder was classified to prepare an insulating toner having an average particle diameter of 13 microns. The resultant toner with positive charging property was subjected to measurements of the physical properties. The volume resistivity was measured under an electric field of $10^4$ v/cm by applying a DC voltage. The results were as follows:

Volume resistivity: $5\times10^{15}$ ohm-cm
Absolute specific gravity: 1.2

(Preparation of a magnetic developer)

The thus prepared ferromagnetic carrier, binder-type magnetic carrier and insulating toner were mixed in the weight ratio 100:100:15 to prepare a magnetic developer for use in the process of the present invention. Using the electrophotographic copying machine of a toner image transfer type comprising a developing device of FIG. 1, electrostatic latent images were developed with the above developer under the conditions listed below. Clear and fine detailed copies with high density were reproduced without fogging and formation of white lines in the solid black image area. The copies have good sharpness and are good in the reproduction of line images. The ferromagnetic carrier particles and binder-type magnetic carrier particles were never attracted to the surface of the photosensitive drum. There were no deterioration in the quality of the copies even after continuous development of 60000 sheets of plain paper with a A4 size.

(Developing conditions)

Photoconductive layer: CdS-resin
Developing sleeve: Aluminum sleeve with a 31 mm diameter,
Rotational speed: 50 rpm
Magnetic roller: 8 poles
Magnetic flux density: 1000 gauss
Rotational speed: 1500 rpm
Gap between photosensitive drum and doctor blade: 0.7 mm
Gap between photosensitive drum and sleeve: 0.7 mm
Peripheral speed of photosensitive drum: 20 cm/sec
Maximum potential of latent images: −550 V
Vias voltage for development: −200 V Determination of preferred mixing ratio of ferromagnetic carrier to binder-type magnetic carrier There were prepared various carrier mixtures of the ferromagnetic carrier and binder-type magnetic carrier, both prepared in Example 1 by mixing them in the weight ratio within the range of 10:190 to 190:10 to determine the preferred mixing ratio of the ferromagnetic carrier to the binder-type carrier. Added to 200 parts by weight of each resultant carrier mixture was 15 parts by weight of an insulating toner prepared in Example 1, to prepare a magnetic developer. Using each of the resultant developer, the copying machine of FIG. 1 was operated under the same conditions as in Example 1 to develop latent images on the photosensitive drum.

Good results were obtained only when a developer comprises the carrier mixture containing 20 to 80 wt% of the ferromagnetic carrier. With the carrier mixture containing 10 wt% of the ferromagnetic carrier, copies have a somewhat low image density, a small quantity of the ferromagnetic carrier particles were attracted to the photosensitive drum. With the carrier mixture containing 95 wt% of the ferromagnetic carrier, copies have white lines in the solid black image area, and the reproduction of the line images is poor in sharpness.

Determination of preferred particle diameter of the binder-type magnetic carrier There were prepared binder-type magnetic carriers having an average particle diameter of 13 to 70 microns by classification of the binder-type magnetic carrier prepared in Example 1. 100 parts by weight of each binder-type magnetic carrier was premixed with 100 parts by weight of a ferromagnetic carrier having an average particle diameter of 50 microns, prepared in Example 1, and then mixed with 15 parts by weight of the insulating toner prepared in Example 1 to prepare a magnetic developer for developing electrostatic latent images.

Using the thus prepared developer mixtures, experiments were conducted to determine the preferred range of average particle diameter of the binder-type magnetic carrier by operating the copying machine under the same conditions as that in Example 1.

Good results were obtained only when the developer containing the binder-type magnetic carrier having an average particle diameter within the range of 20 to 55 microns. With the developer containing the binder-type carrier having an average particle diameter of 13 microns, the attraction of the binder-type magnetic carriers were observed on the surface of the photosensitive drum. With the developer mixture containing the binder-type magnetic carrier having an average particle diameter of 70 microns, rough-grained copies were obtained.

Determination of preferred average particle diameter of the ferromagnetic carrier Using the ferromagnetic carrier prepared in Example 1, there were prepared ferromagnetic carriers each having an average particle diameter of 20 to 120 microns. 100 parts by weight of each ferromagnetic carrier was mixed with 100 parts by weight of a binder-type magnetic carrier having an average particle diameter of 37 microns prepared in Example 1, and the resultant carrier mixture was then mixed with 15 parts by weight of insulating toner prepared in Example 1 to prepare a magnetic developer for developing electrostatic latent images.

Experiments were conducted with the thus prepared developer to determine the preferred average particle diameter of ferromagnetic carriers by operating the copying machine under the same conditions as that in Example 1.

Good results were obtained only when the developer contains the ferromagnetic carrier having an average particle diameter falling within the range of 35 to 90 microns. With the developer containing the ferromagnetic carriers with the average particle diameter of 20 microns, there were obtained copies with a relatively low image density. With the developer containing the ferromagnetic carriers having the average particle diameter of 120 microns, white lines were observed in the solid black image area and rough-grained images were obtained.

COMPARATIVE EXAMPLE 1

A magnetic developer was prepared by mixing 100 parts by weight of the ferromagnetic carrier and 5 parts by weight of insulating toner, both prepared in Example 1. The resultant developer was used for developing electrostatic latent images with the electrophotographic copying machine of FIG. 1 under the same conditions disclosed in Example 1. The copies include a number of white lines in the solid black image area and are poor in the reproduction of line images. In continuous development, the image quality of the copies become much decreased in a short time and the copies with no images were produced thereafter. The observation of the surface of the developing sleeve proved that the carrier particles have aggregated in a hard fin-like form, and never been carried by the rotating magnetic field.

COMPARATIVE EXAMPLE 2

A magnetic developer was prepared by mixing 100 parts by weight of the binder-type magnetic carrier and 10 parts by weight of the insulating toner, both of which were prepared in Example 1.

The resultant magnetic developer was used for developing electrostatic latent images. The development was carried out by operating the copying machine under the same conditions as in Example 1. The copies had a somewhat low image density, and the attraction of the carrier particles was observed on the non-image area of the photosensitive drum. It is believed that these deficiencies result from the high insulating property of the carriers and low magnetic attraction between the carrier particle and the magnetic roller.

EXAMPLE 2

(Preparation of ferromagnetic carrier)

Using the raw materials used in Example 1, a ferromagnetic carrier having a composition: $(NiO)_{0.3}(ZnO)_{0.7}(Fe_2O_3)_{0.85}$ was prepared in the same manner as in Example 1. A ferromagnetic carrier having an average particle diameter of 75 microns was prepared by classification. The physical properties of the resultant ferromagnetic carrier were as follows:

Coercive force: 0 öerstead

Volume resistivity: $5\times10^8$ ohm-cm (Preparation of binder-type magnetic carrier)

Hymer SBM73: 100 parts by weight

Magnetic iron oxide "KBC-100L" (Trademark of Kanto Denka Kogyo Co., Ltd.): 150 parts by weight Carbon black: 4 parts by weight The above composition was fused and mixed in a ball-mill, cooled, crushed, and then powdered in the same manner as in Example 1 to prepare the binder-type magnetic carrier having an average particle diameter of 32 microns. The physical properties were as follows:

Coercive force: 120 öerstead

Volume resistivity: $10^{14}$ ohm-cm (Preparation of insulating toner)

Hymer SBM73: 100 parts by weight

Magnetic iron oxide "MTA-740" (Product of Toda Kogyo Co., Ltd; average particle diameter: 0.25 microns) 20 parts by weight Negative charge control agent "TRH" (Product of Hotogaya Chemical Co., Ltd.): 4 parts by weight Carbon black: 4 parts by weight The above composition was ball-milled, crushed and then powdered in the same manner as in Example 1 to prepare an insulating toner. There was prepared an insulating toner having a negative charging property and an average particle diameter of 14 microns. The volume resistivity: $2\times10^{15}$ ohm-cm.

The thus prepared ferromagnetic carrier, binder-type magnetic carrier and insulating toner were mixed in the weight ratio of 100:100:25 to prepare a magnetic developer.

The thus obtained developer was used for developing latent images by operating the copying machine of FIG. 1 under the same conditions as in Example 1, except for that the maximum potential of the electrostatic latent images was +600 V, that the developing sleeve was applied a vias voltage of +200 V, and that the drum has a photoconductive layer comprising Se-Te. The resultant copies showed excellent reproducibility of gradation, and clear and sharp images.

EXAMPLE 3

(Preparation of insulating toner)
Priolite ACL(Trademark): 100 parts by weight
KBC-100L(Trademark): 80 parts by weight
TRH(Trademark): 4 parts by weight
Carbon black: 2 parts by weight
The above composition was ball-milled, crushed, powdered, and classified in the same manner as in Example 1 to prepare an insulating toner having a negative charging property and an average particle diameter of 13 microns. The volume resistivity was $1\times10^{15}$ ohm-cm and the absolute specific gravity was 1.65.

Using the ferromagnetic carrier and the binder-type carrier prepared in Example 1, a carrier mixture was prepared by mixing them in the weight ratio of 1:1. The resultant carrier mixture (60 g) was placed in the tank 13 of the developing device shown in FIG. 2 arranged in a electrophotographic copying machine of a toner image transfer type. After preoperating the developing device, a large amount of the magnetic toner was placed in the toner tank 12. The process of developing latent images was carried out by operating the copying machine of FIG. 2 under the following conditions.

(Developing Conditions)
Photoconductive layer: Se-Te
Developing sleeve: Aluminum cylinder with a 24 mm diameter,
Rotational speed: 80 rpm
Magnet roller: 8 poles,
magnetic flux density: 800 gauss
Rotational speed: 700 rpm
Gap between preliminary brush control plate and developing sleeve: 1.0 mm
Gap between doctor blade and sleeve: 0.35 mm
Gap between sleeve and photosensitive drum: 0.45 mm
Peripheral speed of photosensitive drum: 11 cm/sec
Maximum potential of latent images: +600 V
Bias voltage for development: +200 V The mixing weight ratio at the developing area (B) of the ferromagnetic carrier, binder-type carrier and toner was 100:100:60.

Copies with high density, clear and sharp images were reproduced without fogging and aggregation of carriers for a prolonged cycles of developing.

A ferromagnetic carrier and a binder-type magnetic carrier, both prepared in Example 3, were mixed to prepare carrier mixtures having a weight ratio of the ferromagnetic carrier to the binder-type magnetic carrier ranging from 10:190 to 190:10. Each of the resultant carrier mixture was used for developing electrostatic latent images on the photoconductive drum 1 shown in FIG. 2 by placing it in the carrier tank 13. The copying machine of FIG. 2 was operated under the same conditions as that in Example 3. The amount of the carrier mixture to be placed in the carrier tank 13 was adjusted within the range of 40 to 60 g so that the weight ratio of the carrier to the toner in the developing area (B) falls within the range of 200:40 to 200:80.

Clear and sharp copies with high reproduction of gradation were obtained when the carrier mixture containing 10 to 70 wt% of the ferromagnetic carrier was used. With the carrier mixture containing less than 10 wt% of the ferromagnetic carrier, copies with a somewhat low image density were obtained. With the carrier mixture containing the ferromagnetic carrier in an amount more than 70 wt%, the aggregation of the developer was observed on the developing sleeve and white lines were observed in the solid black image area of the copies.

COMPARATIVE EXAMPLE 3

In Example 3, a ferromagnetic carrier (100 g) prepared in Example 1 was used as a carrier to be placed in the carrier tank 13 instead of the carrier mixture, and the development of electrostatic latent images was carried out in the same manner as in Example 3 under the same conditions. White lines were observed in the solid black image area of the copies because of high magnetization of the developer. Also, the copies were poor in the reproduction of line images.

COMPARATIVE EXAMPLE 4

In Example 3, a binder-type magnetic carrier prepared in Example 1 was used as a carrier to be placed in the carrier tank 13 instead of the carrier mixture to develop electrostatic latent images. Copies with a low image density were obtained, and the attraction of the carrier particles was observed on the non-image area of the photosensitive drum.

EXAMPLE 4

(Preparation of insulating toner)
Hymer SBM73: 100 parts by weight
RB-BL: 60 parts by weight
Nigrosine base EX: 5 parts by weight
Carbon black: 3 parts by weight The above composition was fused and mixed in a ball-mill, cooled, crushed and then powdered in the same manner as in Example 1 to prepare an insulating magnetic toner having positive charging property and an average particle diameter of 14 microns. The resultant insulating toner had volume resistivity of $2\times10^{15}$ ohm-cm and an absolute specific gravity of 1.5.

Using the thus prepared insulating magnetic toner, development of electrostatic latent images was carried out by operating the copying machine of FIG. 2 in the same manner as in Example 3 under the same conditions. In this case, the photoconductive drum 1 was replaced with a CdS-resin photosensitive drum. The maximum potential of the electrostatic latent images was set to −600 V, and the developing sleeve was applied a vias voltage of −250 V.

Clear and sharp copies were obtained as well as that in Example 3. The developer present in the developing area (B) was composed of the ferromagnetic carrier, binder-type magnetic carrier and insulating toner in the weight ratio of 100:100:50.

While there have been described and illustrated preferred embodiments of the present invention, it will be apparent to those ordinarily skilled in the art that numerous alterations, omissions and additions may be made therein without departing from the spirit thereof.

What I claim is:

1. A process for developing electrostatic latent images comprising using a dry magnetic developer comprising an insulating toner and magnetic carriers, said magnetic carriers comprising a ferromagnetic carrier composed of a ferromagnetic material and a binder-type magnetic carrier, said ferromagnetic carrier being composed of resin-coated ferromagnetic material or bare particles of a ferromagnetic material of soft type, said binder-type magnetic carrier being composed of particles of a powdered magnetic material dispersed in a thermoplastic resin binder and having a coercive force greater than that of the ferromagnetic carrier.

2. The process according to claim 1 wherein the toner has an average particle diameter of 9 to 20 microns, wherein the ferromagnetic carrier has an average particle diameter of 35 to 90 microns, and wherein the binder-type magnetic carrier has an average particle diameter of 20 to 55 microns.

3. The process according to claim 2 wherein the binder-type magnetic carrier has an average particle diameter smaller than that of the ferromagnetic carrier.

4. The process according to claim 3 wherein said binder-type magnetic carrier has a coercive force not less than 60 e,uml/o/ erstead.

5. The process according to claim 3 wherein the insulating toner has a volume resistivity of not less than $10^{12}$ ohm-cm.

6. The process according to claim 5 wherein the ferromagnetic carrier has a volume resistivity of $10^{7}$ to $10^{10}$ ohm-cm.

7. The process according to claim 6 wherein binder-type magnetic carrier has a volume resistivity of not less than $10^{12}$ ohm-cm.

8. The process according to claim 7 wherein the insulating toner is substantially of nonmagnetic.

9. The process according to claim 8 wherein the content of the ferromagnetic carrier is 20 to 80 wt% of the combined amount of the ferromagnetic carrier and the binder-type magnetic carrier in the developer.

10. The process according to claim 7 wherein the insulating toner is of magnetic.

11. The process according to claim 10 wherein the content of the ferromagnetic carrier is 10 to 70 wt% of the combined amount of the ferromagnetic carrier and the binder-type magnetic carrier in the developer.

12. The process according to claim 3 wherein the process comprising the steps of forming a magnetic brush with the developer, and brushing a surface of an electrostatic latent image-carrying element with the magnetic brush.

13. The process according to claim 12 wherein the magnetic brush is formed on a surface of a developing sleeve having magnets therein.

14. The process according to claim 13 wherein the magnet is rotated in the sleeve.

15. The process for developing electrostatic latent images according to claim 1 wherein said ferromagnetic carrier composed of resin-coated ferromagnetic material or bare particles of a ferromagnetic material of soft type has a coercive force approximately equal to 0 öersted, and said binder-type magnetic carrier being composed of particles of a powdered magnetic material dispersed in a thermoplastic resin binder has a coercive force of not less than 60 öersteds.

* * * * *